US006755688B2

(12) United States Patent
Hall et al.

(10) Patent No.: US 6,755,688 B2
(45) Date of Patent: Jun. 29, 2004

(54) TERMINAL POSITION DEVICE APPARATUS, METHODS AND ARTICLES OF MANUFACTURE FOR SECURING SEALED MALE CONNECTORS

(75) Inventors: John W. Hall, Harrisburg, PA (US); Keith R. Foltz, Oberlin, PA (US); Bradley S. Buchter, East Berlin, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/100,389

(22) Filed: Mar. 18, 2002

(65) Prior Publication Data

US 2003/0176107 A1 Sep. 18, 2003

(51) Int. Cl.[7] ..... H01R 13/40
(52) U.S. Cl. ..... 439/595
(58) Field of Search ..... 439/595, 752, 439/701, 744

(56) References Cited

U.S. PATENT DOCUMENTS 5,520,553 A * 5/1996 Cecil, Jr. et al. ..... 439/595
5,816,856 A * 10/1998 Kamath et al. ..... 439/595
5,944,558 A * 8/1999 Iwahori ..... 439/595
6,062,906 A * 5/2000 Tanaka ..... 439/595

* cited by examiner

*Primary Examiner*—Ross Gushi

(57) ABSTRACT

Apparatus, methods and articles of manufacture for terminal position assurance are shown, comprised of a housing with pin contact and terminal position assurance means. The terminal position assurance means, as it is installed within the housing, provides a tab that engages a finger within the housing, thereby driving the finger into a recess within the pin contact, and so seating the pin contact within the housing. If more than one pin contact is within the housing, more than one tab and finger are provided. The terminal position assurance means further contains a recess for retrieval so it may be retrieved in the event of maintenance, disassembly, etc. on the connector.

8 Claims, 5 Drawing Sheets

TERMINAL POSITION DEVICE APPARATUS, METHODS AND ARTICLES OF MANUFACTURE FOR SECURING SEALED MALE CONNECTORS

FIELD OF THE INVENTION

The present invention generally relates to articles of manufacture, apparatus and methods for electrical connectors. More particularly, this invention relates to articles of manufacture, apparatus and methods for installing electrical connectors.

BACKGROUND OF THE INVENTION

Sealed wire to wire electrical connectors are used where environmental extremes might exist, in order to protect the electrical connection. Sealed connectors require a greater deal of care in their assembly than ordinary wire to wire connectors in order to offer this higher level of protection. Thus, assembling a sealed connector may be more difficult than an ordinary connector and must be done with care in order to ensure the electrical connection is made.

For example, it is necessary to properly seat male pins in the housing of a male sealed connector. Yet doing so may be difficult because a sealed housing is deeper and contains less space to maneuver the pins into their final position—ready for connection.

Accordingly, it would be helpful to provide a position assurance device to seat or lock male pins in their final position ready for connection. Any such device must take into account keying arrangements. That is, standardized sealed connectors may have specific keying arrangements so that like male connectors may be locked to like female connectors. Therefore, any position assurance device must not interfere with the predetermined keying arrangements already present in the male sealed connector.

Therefore, it is an object of the present invention to provide a terminal position assurance device for seating male pins in a sealed male connector.

It is a further object of the present invention to provide a terminal position assurance device for seating male pins in a sealed male connector that does not interfere with predetermined keying arrangements.

It is a further object of the present invention to provide an easy to use terminal position assurance device for seating male pins in a sealed male connector.

SUMMARY OF THE INVENTION

Figure 1:
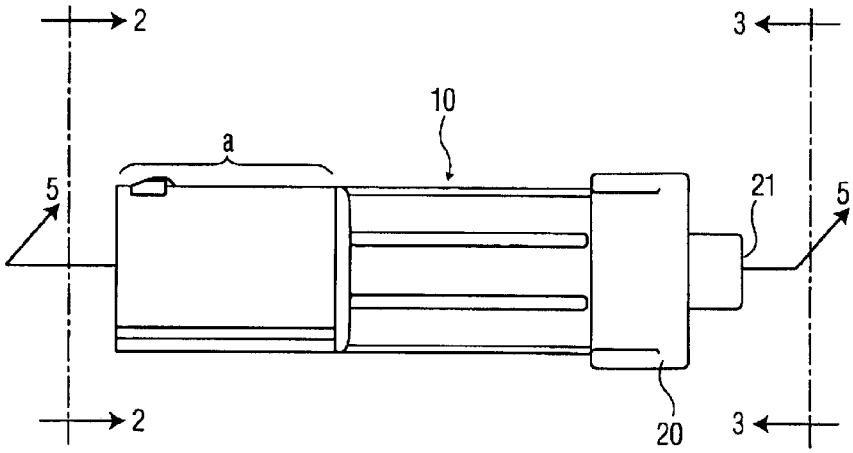
FIG. 1 shows a plan view of a preferred embodiment.

The summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown.

The present invention provides terminal position assurance apparatus, methods, and articles of manufacture. The preferred embodiments comprise a connector with a terminal position assurance device for locking pin contacts within a sealed housing, while assembling the contacts within the housing. The terminal position assurance device comprises an elongated, stepped member, with one or more tabs extending from the floor of the member. The number of tabs is dependant upon the number of contact positions in the particular connector.

When installing the embodiment, the one or more tabs force one or more fingers of the housing into recesses in the contact, thus seating the contact within the housing. The device further contains a recess for retrieval so it may be retrieved in the event of maintenance, disassembly, etc. on the connector.

Additional objects, advantages and novel features of the invention will be set forth in part in the description and figures which follow, and in part will become apparent to those skilled in the art on examination of the following, or may be learned by practice of the invention.

Detailed Description of the Preferred Embodiments

Reference is now made to the accompanying figures for the purpose of describing, in detail, the preferred embodiments of the present invention. The Figures and accompanying detailed description are provided as examples and are not intended to limit the scope of the claims appended hereto.

FIG. 1 shows an outside view of a preferred embodiment of the present invention. A connector is shown generally at 10. At a is seen the mating end of a male housing 10 of the embodiment. Retained within this housing and projecting into the open mating end in a manner not shown here but shown below are the pin, or male, contacts. This is a two position connector embodiment so there are two pin contacts. Other embodiments may have other numbers of contacts, as desired.

The embodiment is keyed as desired along its exterior and/or interior. Insofar as keying may vary from connector to connector, it should be understood that the keying shown here is only of a preferred embodiment, with the appropriate ribs, etc. for that embodiment. Other embodiments may have different keying arrangements.

Cover means 20 is used to cover the end on the embodiment. The pin contacts are inserted within collar 21 in the cover. Not seen here is a wire seal, between the cover and the housing, which helps seal the contact once installed.

Other embodiments of course may use different interior arrangements or appearances, as well as different interior components, such as a double lock plate, etc.

Figure 2:
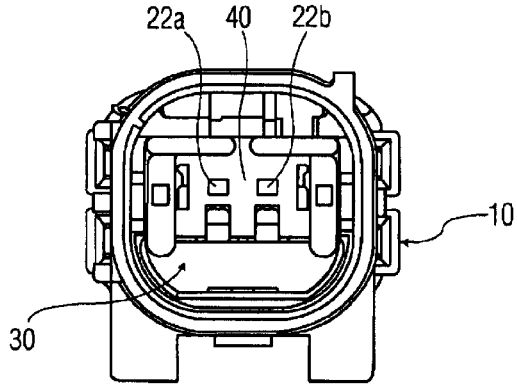
FIG. 2 shows view along line II—II of the embodiment of FIG. 1.

FIG. 2 is a view along line II—II of the embodiment of FIG. 1. FIG. 2 is an end view of the embodiment of FIG. 1. Terminal position assurance (hereinafter "TPA") means 30 is shown as well as face plate 40 of housing 10. Recesses 22*a* and 22*b* are provided for the heads of the to-be-inserted pin contacts.

Figure 3:
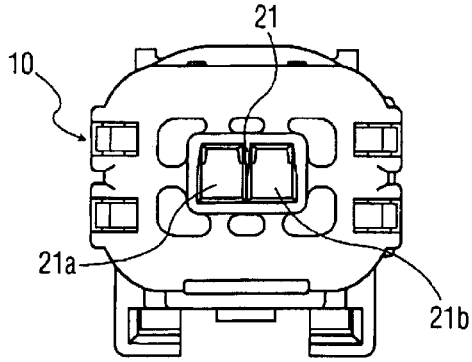
FIG. 3 shows view along line III—III of the embodiment of FIG. 1.

FIG. 3 is a view along line III—III of FIG. 1. Collar 21 is shown with recesses 21*a* and 21*b,* where the pin contacts are inserted.

Figure 4:
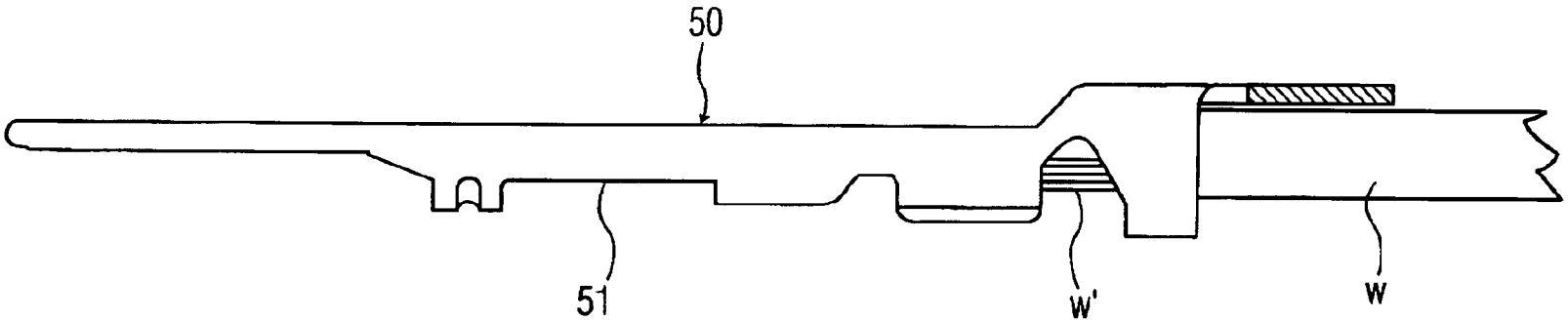
FIG. 4 shows view of pin contact of the embodiment of FIG. 1.

FIG. 4 shows a typical pin contact. At w is an insulated wire and at w' is the wire conductor. Recess 51 provides a recess for a mating finger of the housing, as will be described further below.

Figure 5:
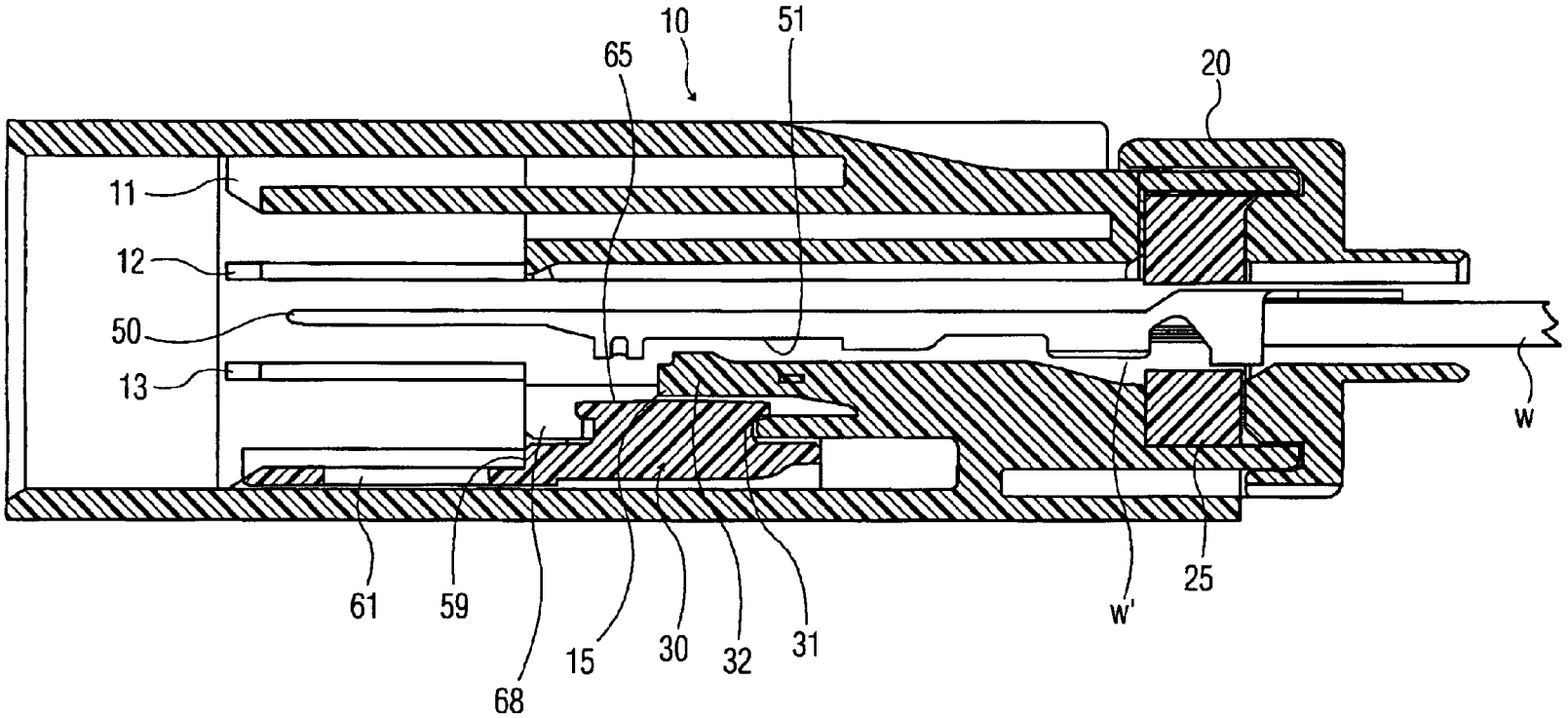
FIG. 5 shows sectional view of the embodiment of FIG. 1.

FIG. 5 shows a sectional view of the embodiment of FIG. 1 with pin contact 50 installed. A single contact is only shown in this view, although, as described above, there are two in this embodiment. Additionally, other embodiments may be single or multiple position connectors. Wire w depends from the pin contact 50, and wire seal 25 surrounds the wire to provide a seal for the wire. Ribs 11, 12 and 13 are provided for the particular keying arrangement of this embodiment, although as described above, other arrangements may be used as desired.

TPA 30 is shown inserted in the front of housing 10. Tab 31 has raised finger 31 into recess 51 of pin contact 50. Thus pin contact 50 has been locked into position.

Figure 6:
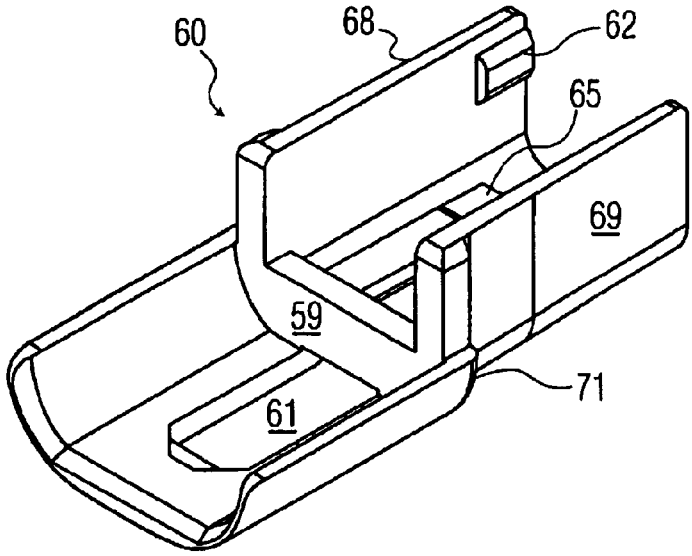
FIG. 6 shows perspective view of another preferred embodiment.

Turning now to FIG. 6 a preferred embodiment of a TPA 60 is shown. Chamfered walls 68 and 69 ease insertion into the open end of a housing. Tab 62 along with tab 63 (not seen here —see FIG. 7) provide guidance within the housing. Wall 59 provides means by which to push the TPA into a housing. As best shown in FIG. 5 and also in FIG. 6 recess 61 formed as an opening provides means to withdraw the CPA after it has been installed for maintenance and the like. Step 71 provides a stop upon installation, so that the TPA cannot be pushed too far into the housing, and thus displace the pin. Tabs 65 and 66 (not seen here, see FIG. 7) that support a locking means for a pin contact are seen as well.

Figure 7:
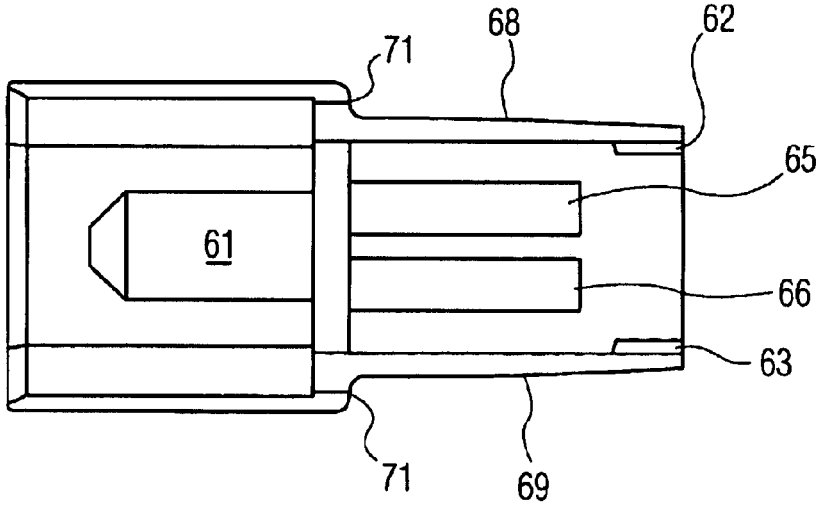
FIG. 7 shows a top view of the embodiment of FIG. 6.
Figure 8:
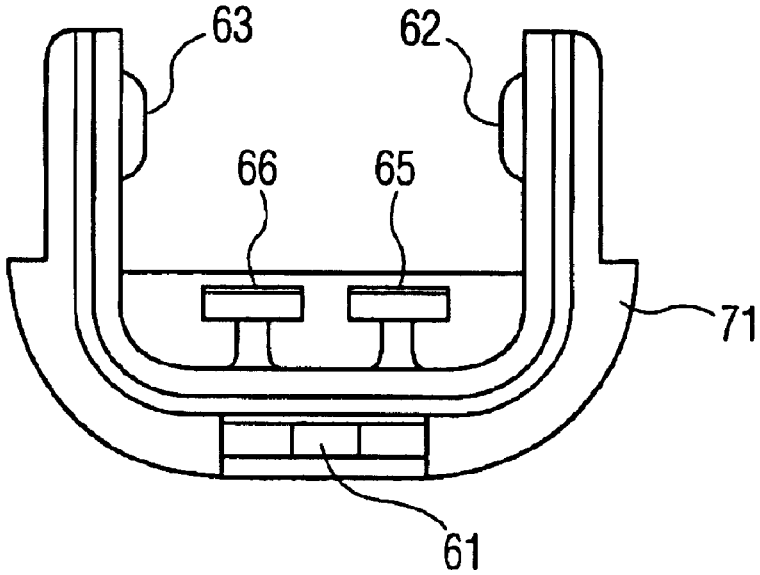
FIG. 8 shows a first end view of the embodiment of FIG. 6.

FIG. 7 presents a top view of the embodiment of FIG. 6. Here tabs 65 and 66 are seen surrounded by chamfered walls 68 and 69. As seen by FIG. 8 these tabs rise from the floor of the TPA, thus providing a means to slide a finger or other locking means in the housing into a recess in the pin contact. Returning briefly to FIG. 6 the end of tabs 65 can be seen to be chamfered, which assists in sliding the tab under the finger or other locking means in the housing. In other embodiments there may be more or less of these tabs depending on the number of pin contacts to be locked. For example, a one position contact would have one tab on a TPA embodiment, a two position contact would have two tabs on a TPA embodiment, a three position contact would have three tabs on a TPA embodiment, etc.

Figure 9:
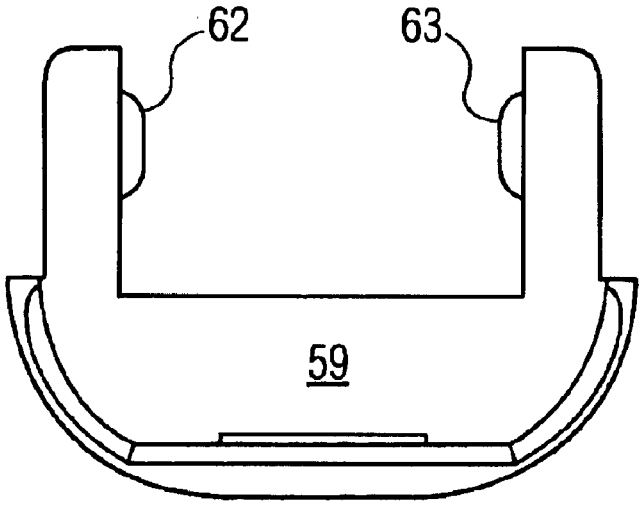
FIG. 9 shows a second end view of the embodiment of FIG. 6.

FIG. 9 is a view from the outside facing end of the TPA.

It should be noted that the external configuration of this embodiment is determined by the housing into which it is to be installed. That is, in this embodiment the TPA is generally externally configured in a U-shape, however, in other embodiments a rounder shape, a more square or box-like shape, etc. may be used depending upon the housing. The number of pins to be accommodated may as well determine the external configurations, i.e., a housing with a greater number of pins may be of different shape than a housing with a lesser number of pins, and the TPA would be configured accordingly.

The above description and the views and material depicted by the figures are for purposes of illustration only and are not intended to be, and should not be construed as, limitations on the invention.

Moreover, certain modifications or alternatives may suggest themselves to those skilled in the art upon reading of this specification, all of which are intended to be within the spirit and scope of the present invention as defined in the attached claims.

We claim:

1. An apparatus for connecting electrical components comprising:

a housing means, comprising an outer wall with inner and outer surfaces with at least one open end, and configured to receive a pin contact;

a pin contact configured to be received within said housing means; and a terminal position assurance means for locking said pin contact within said housing means through at least partial contact with said inner surface of said outer wall, when inserted within said open end of said housing means, said terminal position assurance means is removable from said housing once installed by way of a recess means formed as an opening in said terminal position assurance means and disposed along said inner surface.

2. An apparatus as in claim 1, wherein said housing means further comprises a finger means.

3. An apparatus as in claim 2 wherein said pin contact further comprises a recess means configured to receive said finger means.

4. An apparatus as in claim 3, wherein said terminal position assurance means further comprises a tab means adapted to engage said finger means and thereby slide said finger means into said recess means upon installation of said terminal position assurance means, locking said pin contact within said housing.

5. An apparatus as in claim 4 whereby said terminal position assurance means comprises a plurality of tab means engaging with a plurality of finger means, and thereby locking a plurality of pin contact within said housing.

6. An article of manufacture for locking pin contacts within a housing with an outer end, comprising a terminal position assurance device configured to be inserted within said outer end of said housing, said terminal position assurance device is removable from said housing once installed by way of a recess means disposed thereon said recess means being formed as an opening passing through a wall thereof.

7. An article of manufacture as in claim 6 wherein said terminal position assurance device further comprises an elongated, stepped member, with a tab extending from a floor of the member.

8. An article of manufacture as in claim 7 wherein said terminal position assurance device further comprises an elongated, stepped member with a plurality of tabs extending from the floor of the member.

* * * * *